US005443156A

United States Patent [19]

Shioda

[11] Patent Number: 5,443,156

[45] Date of Patent: Aug. 22, 1995

[54] STOWABLE GOLF BAG COVER

[76] Inventor: Yoshihiko Shioda, 4603 S. Blvd., Charlotte, N.C. 28209

[21] Appl. No.: 245,593

[22] Filed: May 18, 1994

[51] Int. Cl.[6] ..... A63B 55/00

[52] U.S. Cl. ..... 206/315.4; 150/159

[58] Field of Search ..... 190/154, 159, 160; 206/315.3, 315.4

[56] References Cited

U.S. PATENT DOCUMENTS

| | | | |
|---|---|---|---|
| 2,094,186 | 9/1937 | Patrick | 206/315.4 |
| 2,704,563 | 3/1955 | Henrich . | |
| 2,718,251 | 9/1955 | Barbato . | |
| 2,747,637 | 5/1956 | Brown | 150/159 |
| 3,288,189 | 11/1966 | Davis | 150/159 |
| 3,316,951 | 5/1967 | Jacobson | 206/315.4 |
| 4,200,133 | 4/1980 | Whitlow . | |
| 4,953,768 | 9/1990 | Muse | 150/159 X |
| 4,968,048 | 11/1990 | Lortie | 280/47.26 X |
| 4,979,548 | 12/1990 | Howard, III et al. . | |
| 5,005,623 | 4/1991 | Webster, Jr. . | |
| 5,024,259 | 6/1991 | Treadway . | |
| 5,058,642 | 10/1991 | Tuntland . | |
| 5,099,897 | 3/1992 | Curtin . | |
| 5,220,950 | 6/1993 | Cordasco . | |

*Primary Examiner*—Allan N. Shoap
*Assistant Examiner*—Christopher J. McDonald
*Attorney, Agent, or Firm*—Shefte, Pinckney & Sawyer

[57] ABSTRACT

A protective cover, made of flexible and foldable material, for a golf bag and golf clubs contained in the bag. The golf bag cover may be expanded from a collapsed stowed disposition to an expanded cover disposition enclosing the golf bag and the clubs in the golf bag. The golf bag cover includes a cylindrical portion for containing substantially the lengthwise extent of the golf bag, and an end portion integral with the cylindrical portion, to cover the heads of the golf clubs contained in the golf bag. The golf bag cover has opposed edges which extend substantially the full length of the cover when in its covering disposition. The opposed edges may be releasably secured to each other so the edges may be joined in the covering disposition and released for collapsing into the stowed disposition. The cylindrical portion of the golf bag cover is secured to the golf bag along a lengthwise extent of the golf bag.

4 Claims, 6 Drawing Sheets

STOWABLE GOLF BAG COVER

FIELD OF THE INVENTION

The present invention relates generally to golf bag covers and, more particularly, to a golf bag cover which can be collapsed and stowed on the outside of the golf bag, but which, when expanded, covers and protects the golf bag and golf clubs stowed therein.

BACKGROUND OF THE INVENTION

Covers to protect golf bags and the golf clubs contained in them are known. Conventional golf bag covers are available to protect a golf bag during travel and also for use while playing golf in inclement weather.

For example, U.S. Pat. No. 2,718,251 to Barbato discloses a full length golf bag cover which includes an end portion for protecting the heads of golf clubs. U.S. Pat. No. 5,220,950 to Cordasco also discloses a full length golf bag cover and has a number of openings for convenient access to the golf clubs and other items contained in the golf bag.

A golf bag cover has been developed which may be folded and attached to the golf bag when not in use. U.S. Pat. No. 5,099,897 to Curtin discloses this arrangement. However, the Curtin cover, when in use as a cover, only protects the golf club heads and top portion of the golf bag, and is not positively secured around the top opening of the golf bag. The Curtin cover, therefore, only offers partial protection to the golf bag.

A need still exists for a golf bag cover which offers protection to the full length of a golf bag and golf clubs, while also having the capability of being stowed on the outside of the golf bag in a convenient and accessible disposition.

SUMMARY OF THE INVENTION

It is accordingly an object of the present invention to provide an improved golf bag cover which provides secure protection, easy stowage and simple access.

Briefly summarized, the present invention accomplishes this objective by a protective golf bag cover including a cylindrical portion for covering the lengthwise extent of a golf bag, and an end portion which covers the heads of golf clubs contained in the golf bag. The top portion is integral with the cylindrical portion of the golf bag cover. The golf bag cover has edges running the full length of the cover when it is placed around the golf bag. The edges may be sealed by use of a zipper fastener, thereby closing the cover around the golf bag and clubs.

When the zipper fastener is opened, the golf bag cover may be collapsed and folded, and stowed along one lengthwise side of the golf bag. The golf bag cover may be attached to the golf bag along the lengthwise side of the golf bag so that the cover will remain on the bag both when it is protectively covering the golf bag, and when it is stowed on the side of the golf bag.

It is advantageous in the present invention to attach the golf bag cover along a substantial portion of the lengthwise extent of the golf bag. This arrangement provides a secure attachment of the golf bag cover to the golf bag such that it can withstand rough handling during travel and heavy use. This orientation of the attachment further allows the stowed golf bag cover to be positioned so that it does not interfere with use of the golf bag while playing golf.

In order to allow the golf bag to be easily lifted and grasped, it is advantageous if the cylindrical portion of the golf bag cover has an opening through which the handle of the golf bag may be grasped when the golf bag cover is in its covering disposition. The golf bag cover is preferably permanently attached to the golf bag by being sewn onto it. The present invention also contemplates as an alternative the use of a releasable fastener, such as a hook-and-loop fastener, to attach the golf bag cover to the golf bag.

In a preferred embodiment, the golf bag cover does not extend over the bottom of the golf bag when the cover is secured in its covering disposition. By not providing for a bottom-end portion to cover the bottom of the golf bag, the speed and ease of deploying the golf bag cover from its stowed disposition to its covering disposition, and vice versa, are enhanced. The construction of the golf bag cover is also made easier in this embodiment.

Also in the preferred embodiment, the golf bag cover has retaining means for securing the cover when it is disposed around the golf bag. The retaining means may take the form of a number of straps, which can be permanently attached to the cylindrical portion of the golf bag cover.

A cover confining means may be attached to either the golf bag cover or the golf bag, so that the cover confining means can be used to enclose the golf bag cover when it is collapsed and folded along the side of the golf bag. The cover confining means may take the form of a wrap, which may be attached in between the golf bag cover and the golf bag. Further, the wrap may have edges which can be releasably secured to each other around the golf bag cover when the cover is collapsed and folded. In an alternative embodiment, the cover confining means may consist of a number of opposed pairs of straps, with each pair of straps capable of being secured to each other so as to tightly hold the golf bag cover in its stowed disposition.

The invention will be described in further detail below in terms of an exemplary embodiment of a golf bag cover.

DETAILED DESCRIPTION OF THE PREFERRED EMBODIMENT

Figure 1:
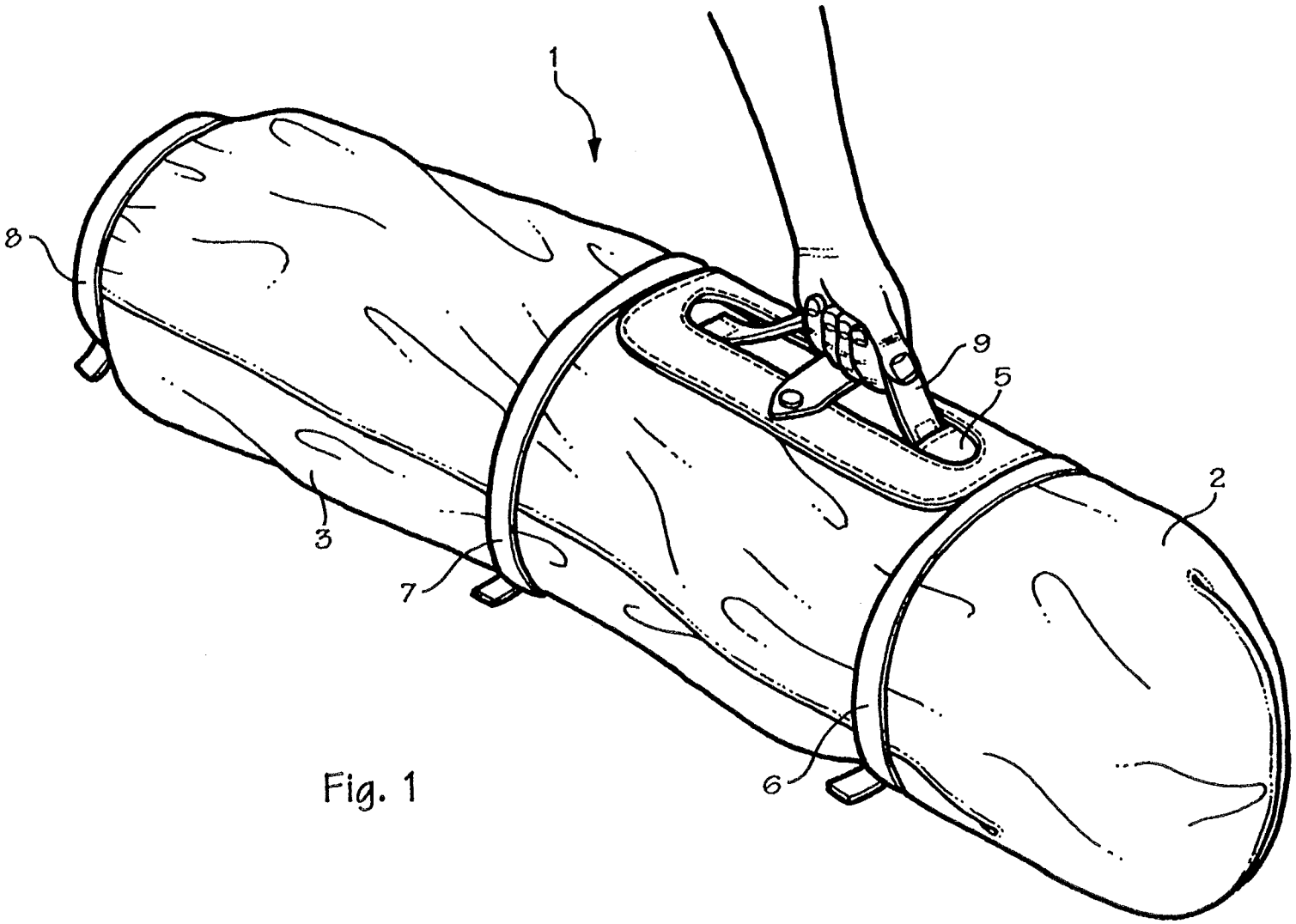
FIG. 1 is a perspective view of a golf bag enclosed in a golf bag cover of the preferred embodiment of the present invention as it may be lifted by the golf bag handle.
Figure 3:
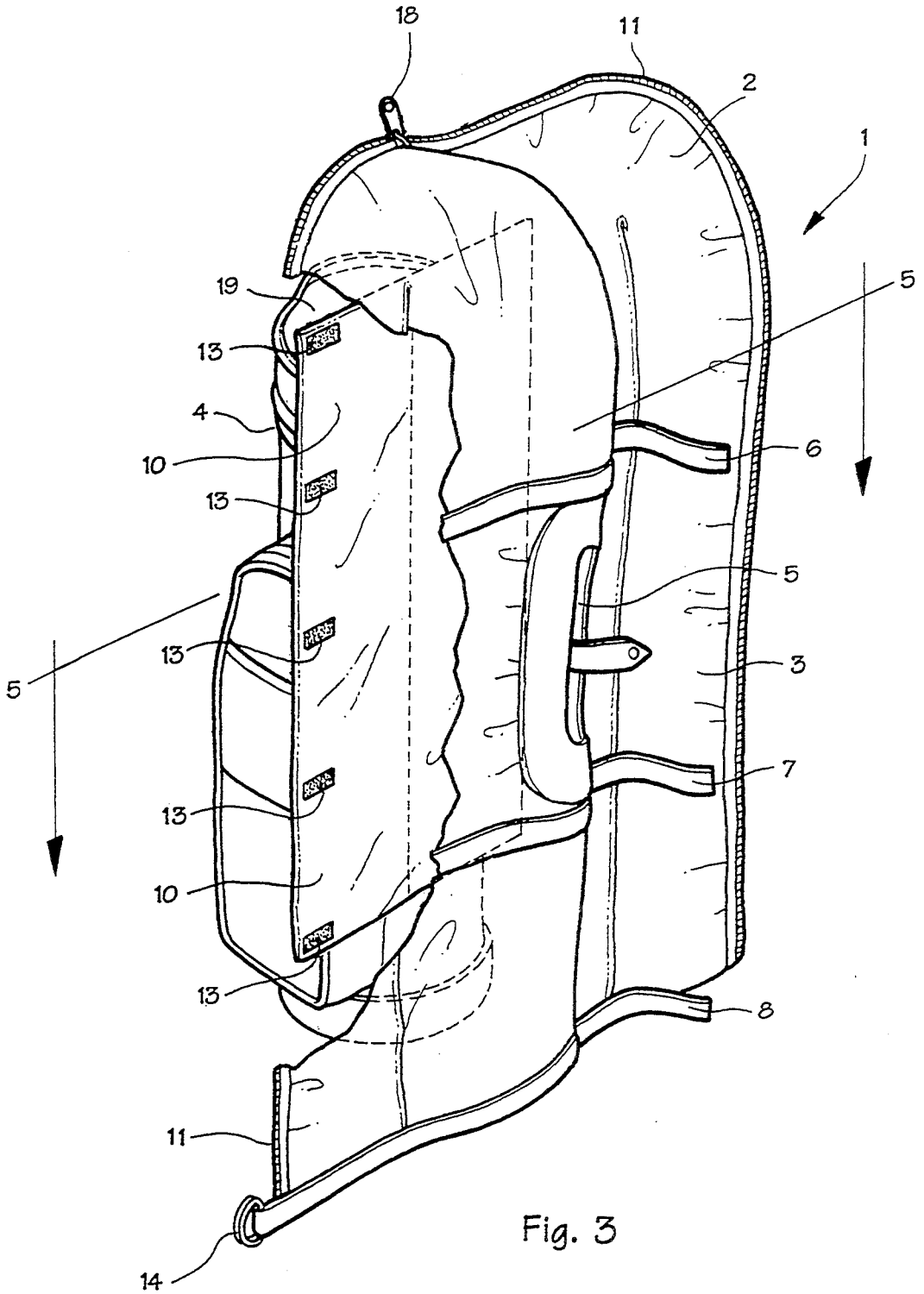
FIG. 3 is a perspective view of the golf bag and cover of FIG. 1 in partial section showing the golf bag cover partially disposed to cover the golf bag, and also showing the wrap in between the golf bag cover and the golf bag.

Referring now to the accompanying drawings, FIG. 1 shows a stowable protective golf bag cover 1 in a covering disposition, in which it protects a golf bag, the handle 9 of which can be seen protruding through an opening 5 in the cover 1. The golf bag cover 1 is made of flexible and foldable material, such as woven fabric, for expanding from its stowed disposition to its covering disposition. The cover 1 includes a cylindrical portion 3 which encircles the golf bag 4 below the bag's open end 19, as can be seen in FIG. 3. The cylindrical portion 3 is integral with an end portion 2, which extends above the open end 19 of the golf bag 4 in order to protect the heads of golf clubs contained in the golf bag 4. When deployed in its covering disposition, the cover 1 is secured by straps 6,7,8.

Figure 2:
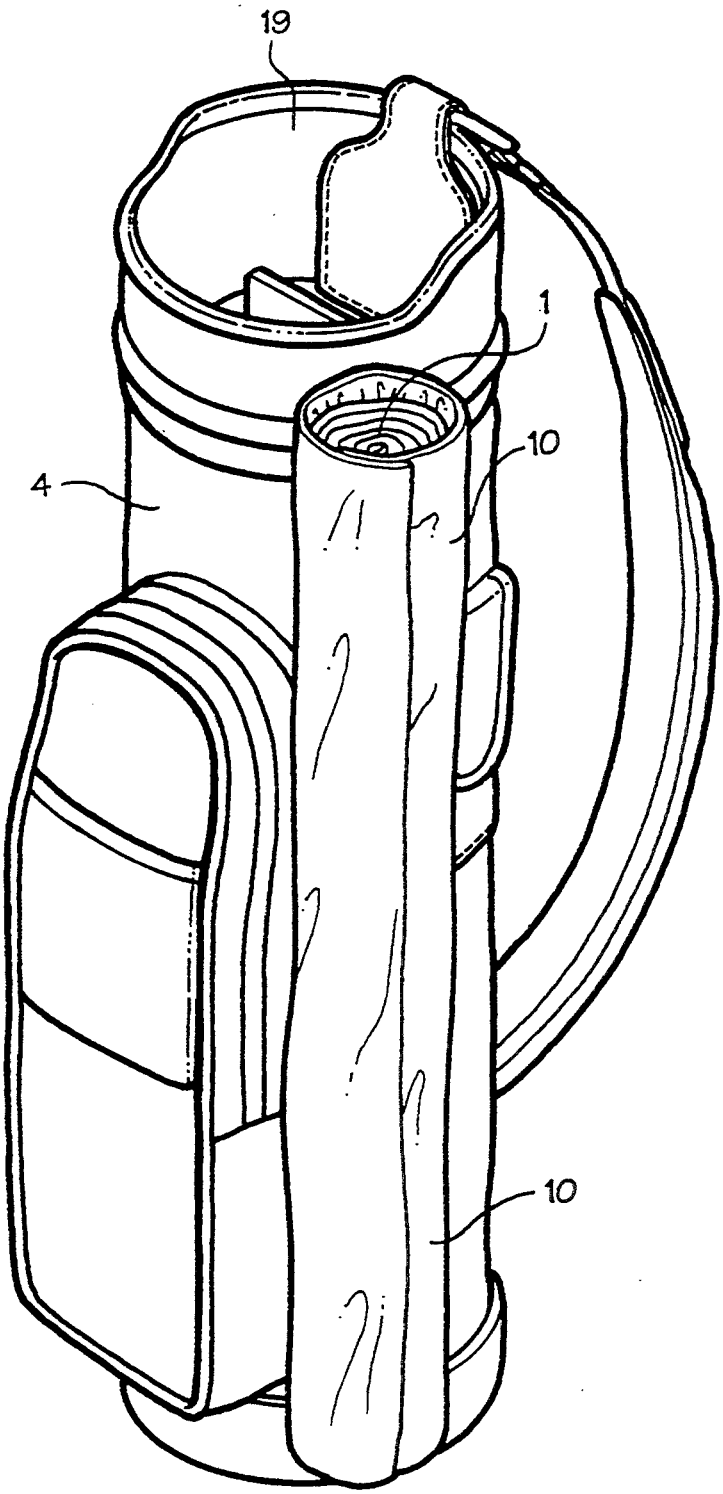
FIG. 2 is a perspective view of the golf bag and cover of FIG. 1 showing the golf bag cover collapsed and folded in its stowed disposition with a wrap member covering it.
Figure 5:
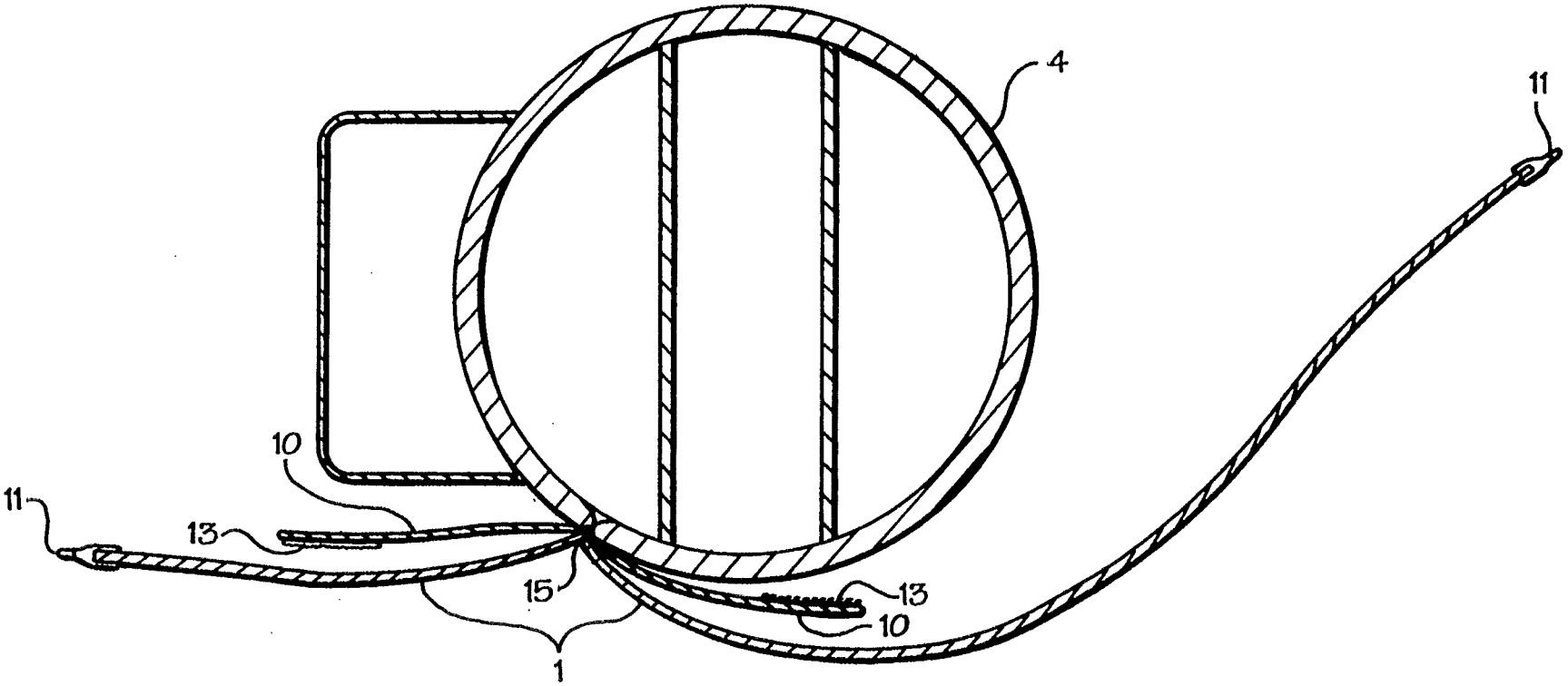
FIG. 5 is a horizontal sectional view of the golf bag and cover of FIG. 1.

For play, the cover 1 can be collapsed into its stowed disposition as shown in FIG. 2, in which the cover 1 forms a compact tubular configuration. A cover confining means in the form of wrap 10, which is composed of a sheet of material similar to that of the cover 1, surrounds and secures the cover 1 in its stowed disposition, holding it in a compact form. The cover 1 and wrap 10 are secured to the golf bag 4 as by stitching as depicted in FIG. 5 or by other means along a lengthwise extent of the golf bag 4, so that the cover 1 and wrap 10 do not impede access to and use of the golf bag 4 during play. While this arrangement precludes interference by the cover 1 in its stowed disposition with usage of the golf bag 4, the cover 1 is within ready and convenient access so that it may be quickly deployed when needed, for example in inclement weather or at the conclusion of play.

A means for releasably securing the opposed edges of the cover 1 in the form of a zipper fastener 11 extends along the opposed edges of the cover 1, running along the length of the cylindrical portion 3 and up to the crown of the top portion 2, as shown in FIG. 3. When collapsing the cover 1 from its covering disposition, as shown in FIG. 1, to its stowed disposition, as shown in FIG. 2, the zipper fastener 11 is unzipped and straps 6,7,8 unfastened, as depicted in FIG. 3. The cover 1 may then be folded into a compact tubular form, and secured by the wrap 10, as shown in FIG. 2. The wrap 10 has Velcro fasteners 13 spaced along its lengthwise edges so that it may be releasably fastened securely around the folded cover 1 in its stowed disposition.

The zipper 11 may be disposed so that the slide fastener 18 travels either upward or downward to close the cover 1. If the slide fastener 18 is disposed to travel upward when closing the cover 1, the slide fastener 18 may then be partially opened to allow access to the golf bag 4 through the end portion 2 of the cover 1, without requiring the zipper 11 to be completely opened. This arrangement is particularly beneficial if a golfer should desire to remove one or more golf clubs, while retaining the cover 1 in place, which may be advantageous while playing golf in inclement weather.

Figure 4:
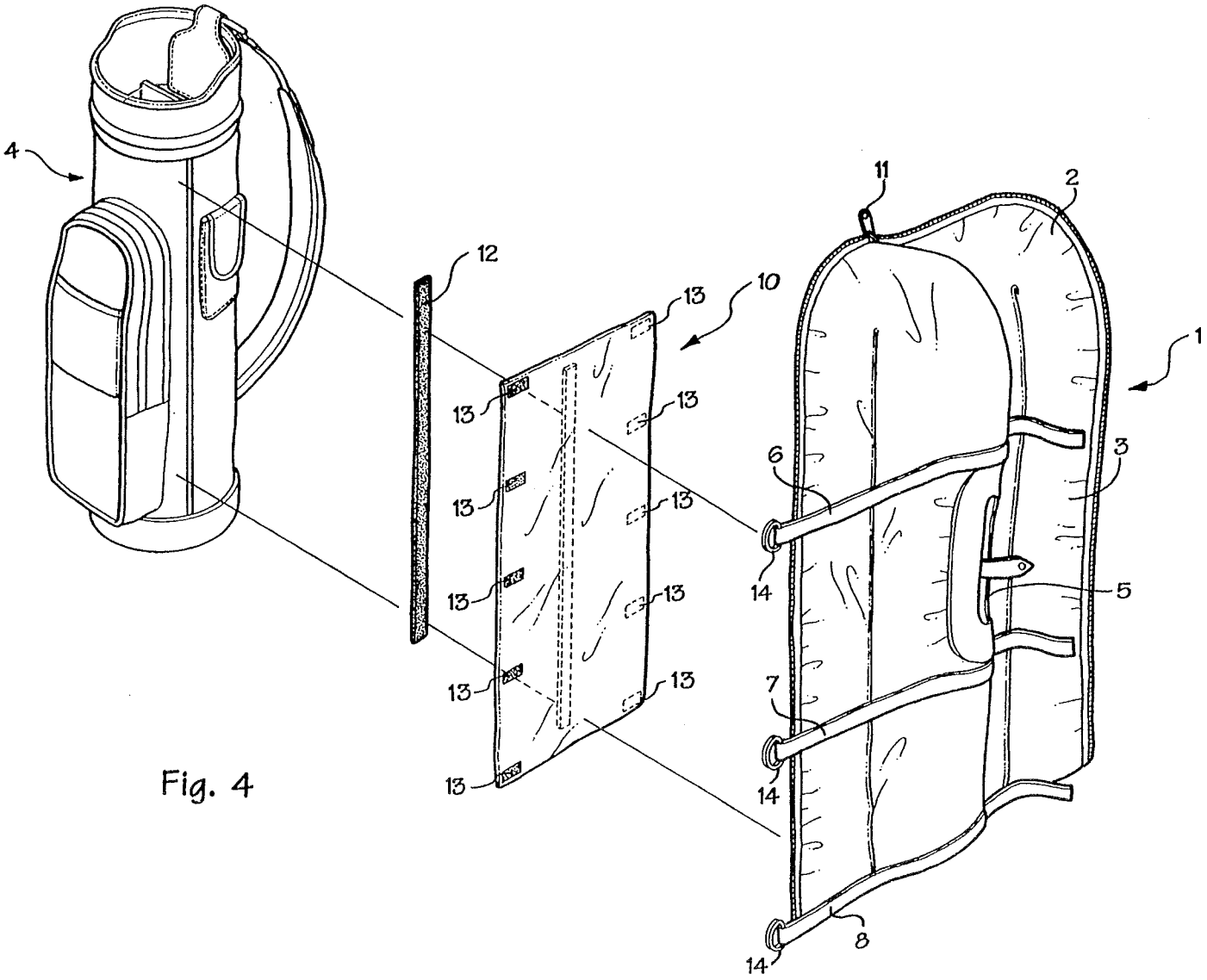
FIG. 4 is an exploded perspective view of the golf bag and cover of FIG. 1.

In a preferred embodiment of the present invention, the wrap 10 is releasably secured to the golf bag 4 by a hook-and-loop fastener 12 and the wrap 10 is secured to the cover 1 as by stitching or other means or the cover 1 could be unsecured to the wrap 10 except by being enclosed in the wrap 10 itself when the cover 1 is in the stowed disposition. This arrangement, which is depicted in FIG. 4, allows a golfer to remove the wrap 10 and cover 1 from the golf bag in order to play golf without having these items secured on the outside of the golf bag 4. The weight and bulk of the golf bag would thus be reduced, allowing a golfer to more easily carry the golf bag 4.

A retaining means for securing the cover 1 in its covering disposition on the golf bag is provided in the form of straps 6,7,8. The straps 6,7,8 are secured to the cover 1 and have buckles 14 on one end in which the other end may be inserted, which allows the straps to be locked end to end. Straps 6,7,8 can thus be cinched tightly to maintain the cover 1 on the golf bag 4 during rough handling and heavy use. Straps 6,7,8 may be permanently secured to the cylindrical portion 3 of the cover 1 by stitching or other means. The bottom strap 8 is of particular importance in that it must be fastened securely to hold the cover 1 around the bottom of the golf bag 4. In this preferred embodiment, the cover 1 does not extend across the bottom of the golf bag 4.

Figure 6:
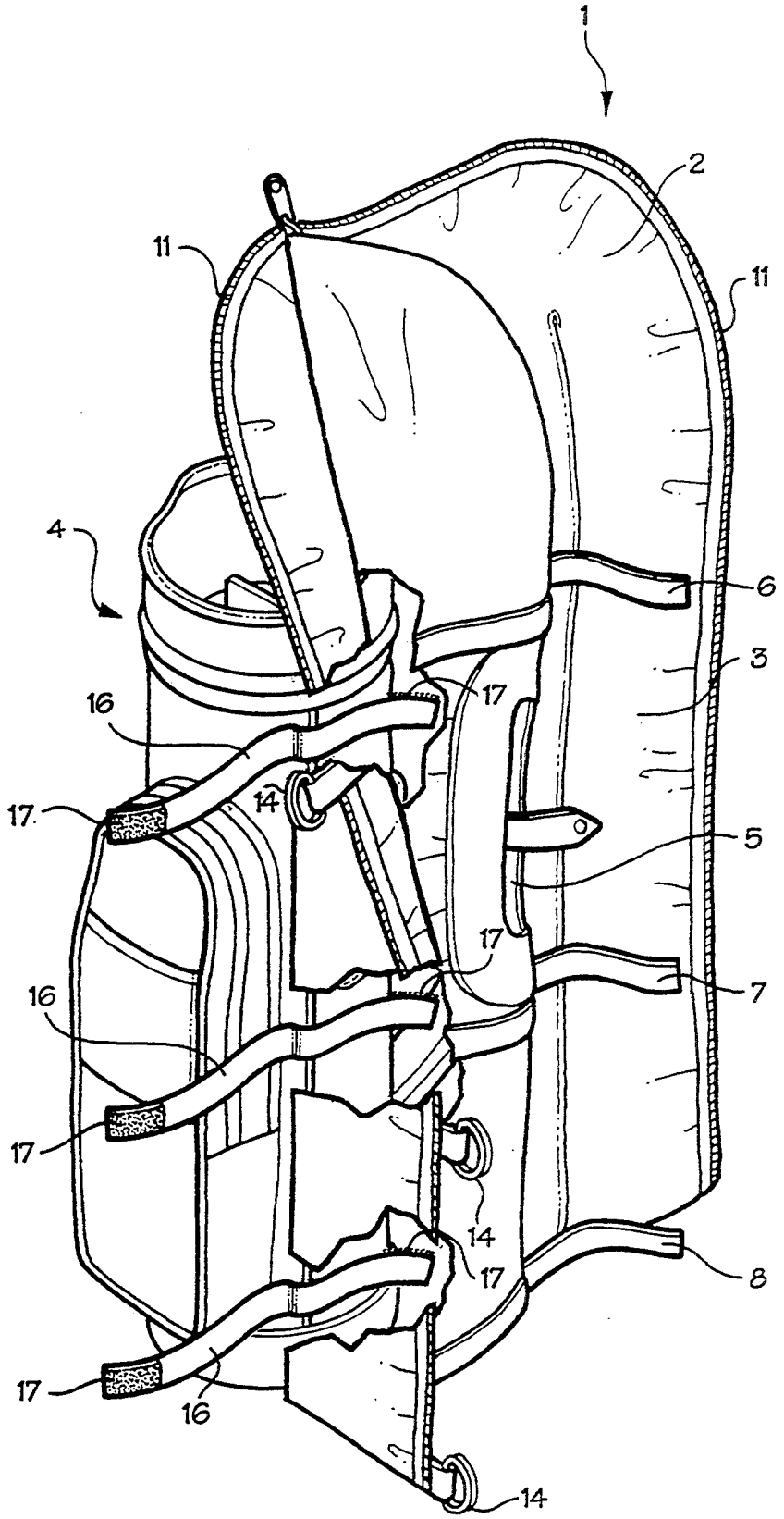
FIG. 6 is a view similar to FIG. 3, showing an alternate form of the wrap member.

A variation of the present invention is illustrated in FIG. 6, in which cover confining means in the form of restraining straps 16 are employed. Restraining straps 16 perform essentially the same function as wrap 10 in other variations but are lighter and less bulky. Securing means in the form of hook-and-loop fasteners 17 are located on the ends of restraining straps 16, allowing restraining straps 16 to be securely fastened around cover 1 when cover 1 is in its stowed disposition.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In the combination of a golf bag for containing golf clubs and a protective cover for golf bag and golf clubs, said cover being made of flexible and foldable material for expanding from a collapsed stowed disposition to an expanded golf bag and club covering disposition, said cover comprising:

a cylindrical portion formed for containing and covering substantially the entire lengthwise extent of said golf bag;

an end portion integral with said cylindrical portion and having a lengthwise and crosswise extent sufficient to cover the heads of golf clubs contained in said golf bag;

said cover having opposed edges extending substantially the full length of said cover when said cover is in its covering disposition;

means for releasably securing said edges together to close said cover in its covering disposition with the golf bag and clubs therein, and releasable to allow collapsing of said cover from its covering disposition to its stowed disposition extending lengthwise along the golf bag;

means for securing said cylindrical portion to said golf bag along a lengthwise extent of the golf bag to retain said cover on said golf bag in both the covering and stowed disposition of said cover; and a wrap member for releasably confining said cover in said stowed disposition and secured to one of said cylindrical portion and said golf bag for releasably encircling said cover in its stowed disposition, said wrap member extending over a substantial portion of said stowed cover.

2. The golf bag cover according to claim 1 and further characterized in that said wrap member is secured intermediate its ends intermediate said cylindrical portion and said golf bag.

3. The golf bag cover according to claim 1 and further characterized in that said wrap member is releasably secured intermediate its ends to said golf bag and is secured intermediate its ends to said cylindrical portion.

4. The golf bag cover according to claim 2 and further characterized in that, said wrap member has opposed edges extending substantially the full length of said wrap member, said opposed edges being releasably securable to each other to dispose said wrap member in wrapping relation around said cover when said cover is in its stowed disposition.

* * * * *